US009370288B2

(12) United States Patent
Karlsson

(10) Patent No.: US 9,370,288 B2
(45) Date of Patent: Jun. 21, 2016

(54) VACUUM CLEANER NOZZLE COMPRISING FLEXIBLE BELLOW ARRANGEMENT

(75) Inventor: Roger Karlsson, Stockholm (SE)

(73) Assignee: Aktiebolaget Electrolux (SE)

( * ) Notice: Subject to any disclaimer, the term of this patent is extended or adjusted under 35 U.S.C. 154(b) by 0 days.

(21) Appl. No.: 14/384,066

(22) PCT Filed: Mar. 14, 2012

(86) PCT No.: PCT/EP2012/054422

§ 371 (c)(1),
(2), (4) Date: Sep. 9, 2014

(87) PCT Pub. No.: WO2013/135278

PCT Pub. Date: Sep. 19, 2013

(65) Prior Publication Data

US 2015/0026921 A1 Jan. 29, 2015

(51) Int. Cl.
*A47L 9/24* (2006.01)
*A47L 9/02* (2006.01)

(52) U.S. Cl.
CPC .. *A47L 9/248* (2013.01); *A47L 9/02* (2013.01)

(58) Field of Classification Search
CPC ..... A47L 9/02; A47L 9/248
IPC ..... A47L 9/24
See application file for complete search history.

(56) References Cited

U.S. PATENT DOCUMENTS 3,255,780 A 6/1966 Squirrell
8,820,364 B2 * 9/2014 Diels ..... B29C 53/086 138/121

FOREIGN PATENT DOCUMENTS

| | | |
|---|---|---|
| DE | 29624393 | 3/2003 |
| FR | 1357484 | 4/1964 |
| WO | 2005074778 | 8/2005 |
| WO | 2010086819 | 8/2010 |
| WO | 2010095995 | 8/2010 |
| WO | 2011007158 | 1/2011 |

OTHER PUBLICATIONS

International Search Report for PCT/EP2012/054422 mailed Oct. 5, 2012.
Chinese Office Action dated Dec. 4, 2015 for Chinese Application No. 201280067099.6 with translation.

* cited by examiner

*Primary Examiner* — David Redding
(74) *Attorney, Agent, or Firm* — RatnerPrestia

(57) ABSTRACT

A vacuum cleaner nozzle having a flexible bellow arrangement for connecting a nozzle inlet to a nozzle outlet. The bellow arrangement has a flat inside surface.

18 Claims, 5 Drawing Sheets

VACUUM CLEANER NOZZLE COMPRISING FLEXIBLE BELLOW ARRANGEMENT

This application is a National Stage Application of International Application No. PCT/EP2012/054422, filed Mar. 14, 2012, the entire disclosure of which is expressly incorporated by reference herein.

TECHNICAL FIELD

The invention relates to a vacuum cleaner nozzle comprising a flexible bellow arrangement.

BACKGROUND

Prior art vacuum cleaners as disclosed in e.g. WO 2005/074778 may be arranged with a flexible hose or bellow between an inlet and outlet of a vacuum cleaner nozzle and a suction tube for transporting particles picked up by a nozzle intake from a surface to be cleaned, such as threads, lint, human or animal hairs or other debris, via a suction hose to a bag or cyclone arrangement located in a main body of the vacuum cleaner for housing the debris. When air is drawn with high velocity through the nozzle and suction tube/hose, turbulence may result in an increased noise level of the vacuum cleaner.

SUMMARY

An object of the present invention is thus to solve, or at least mitigate, this problem in the art and provide a vacuum cleaner nozzle having a flexible bellow where the air can flow in a more unimpeded manner, which results in a less noisy vacuum cleaner.

This object is attained according to the present invention by a vacuum cleaner nozzle comprising a flexible bellow arrangement for connecting a nozzle inlet to a nozzle outlet, which flexible bellow arrangement has a flat inside surface.

Thus, the bellow arrangement has a flat inside surface, which is advantageous for lowering the noise level of a vacuum cleaner in which the bellow arrangement is mounted. The air drawn through the bellow arrangement will by means of the flat inside surface flow freely and smoothly. The bellow arrangement can be arranged such that its cross-sections takes on any appropriate form, e.g. circular, oval or rectangular.

In an embodiment of the present invention, the flexible bellow arrangement of the vacuum cleaner nozzle comprises a tubular bellow and a plurality of elements axially arranged inside the bellow for radially supporting the tubular bellow. Further, the elements have a flat inside surface and are arranged to axially move in relation to each other. This movement may occur for example when the bellow is expanded, compressed or bent.

Hence, by means of the elements, the bellow arrangement has a flat circumferential inside surface, which is advantageous for lowering the noise level of the vacuum cleaner in which the bellow arrangement is mounted. By having a flat circumferential inside surface, the air drawn through the bellow arrangement will flow freely and smoothly, without causing air flow in and around the bellow corrugations.

Further advantageous is that the elements provide stability along their radial axes thereby preventing the bellow from collapsing from the vacuum arising inside the bellow. By arranging the elements such that they axially can move in relation to each other when the bellow is expanded, compressed or bent, bellow flexibility is facilitated.

In an embodiment of the present invention, each element is fastened at an inside surface of the tubular bellow. Any appropriate fastening means can be employed, such as adhesive. In further embodiments of the present invention, the shape of the elements are annular, oval or rectangular. In the following, the elements will be referred to as annular.

In an embodiment, each annular element is arranged with a radially protruding flange along its circumference for engagement with a respective corrugation of the tubular bellow. By having the flange of each annular element engage with a corresponding bellow corrugation, the annular elements are fastened to the bellow without having to apply a fastening means such as adhesive. Further, by ensuring an accurate and tight flange engagement with the respective corrugation, there is little risk that an annular element will disengage with the bellow.

In a further embodiment of the present invention, the annular elements are arranged in the bellow such that two adjacent annular elements become axially displaced from each other when the bellow is expanded and moves into contact with each other when the bellow is compressed. Advantageously, this increases the flexibility of the bellow arrangement.

In yet a further embodiment of the present invention, at least one axial end face of each annular element is bevelled such that an annular element can slide onto an adjacent annual element which abuts the bevelled axial end face when the bellow is compressed. Advantageously, by providing at least one of the two axial end faces of the annular elements with a bevelling, sliding of an annular element onto an abutting adjacent annular element is facilitated, thereby allowing the bellow arrangement to be flexible.

In still another embodiment of the present invention, both axial end faces of each annular element are bevelled such that an annular element can slide onto an adjacent annual element which abuts one of the two bevelled axial end face when the bellow is compressed. Advantageously, the bevelling of each axial end face of an annular element is made such that it is fitted with the respective abutting axial end face of its two adjacent annular elements, thereby allowing further bellow arrangement flexibility.

It is noted that the invention relates to all possible combinations of features recited in the claims. Further features of, and advantages with, the present invention will become apparent when studying the appended claims and the following description. Those skilled in the art realize that different features of the present invention can be combined to create embodiments other than those described in the following.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art.

Figure 1:
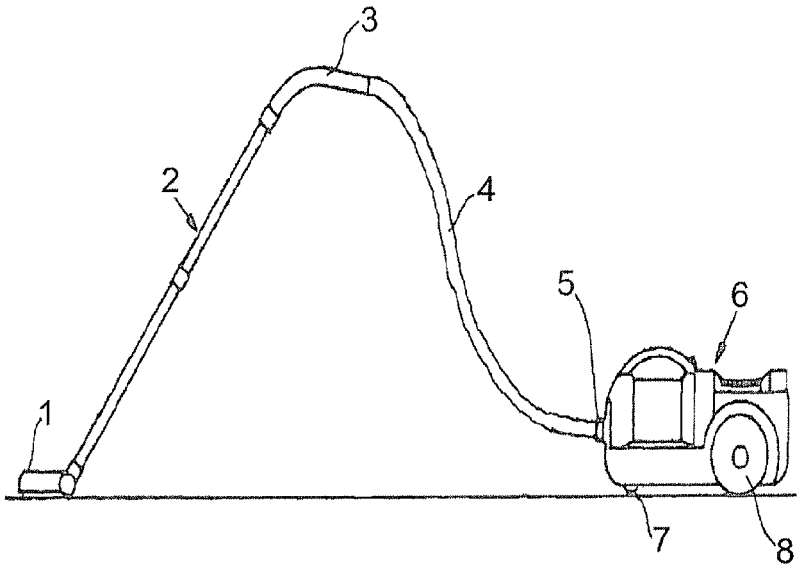
Fig. 1 Prior Art
FIG. 1 illustrates a general vacuum cleaner known in the art.

FIG. 1 illustrates a general vacuum cleaner known in the art. The vacuum cleaner has a nozzle 1 connected to a suction tube 2 that, via a tube handle 3 and a suction hose 4 with a hose connection 5, is secured to a main body 6 of the vacuum cleaner. The vacuum cleaner main body 6 is supported by a front pivot wheel 7 and two rear wheels 8. Inside the main body is a dust bag or cyclone arrangement for collecting debris picked up by the nozzle 1 and transported by the suction tube 2 and hose 4.

Figure 2:
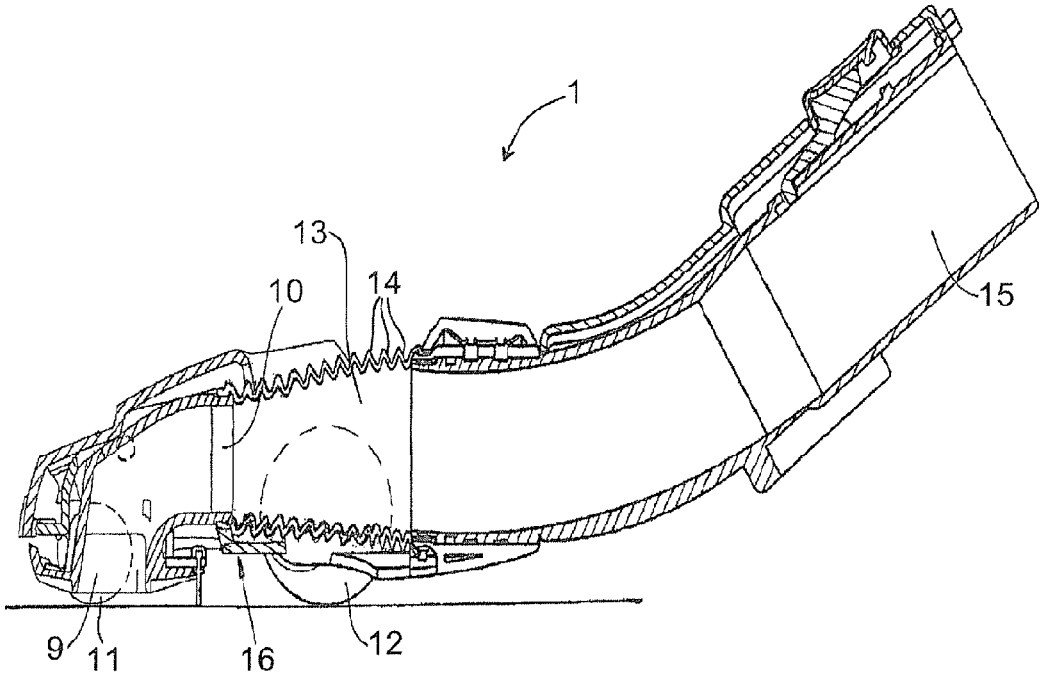
Fig. 2 Prior Art
FIG. 2 shows a detailed sectional view of a more elaborate prior art vacuum cleaner nozzle and suction tube.

FIG. 2 shows a detailed sectional view of a more elaborate prior art vacuum cleaner nozzle. This particular nozzle 1 has a nozzle body 16 with an elongated suction opening 9, i.e. a nozzle inlet, that faces the surface being cleaned and that extends in the transverse direction with respect to the direction of movement of the nozzle 1. The suction opening 9 communicates via an air passage with a tubular outlet 10 for transporting debris to a dust bag or cyclone arrangement housed in a main body (not shown) of the vacuum cleaner via a nozzle outlet 15 to be connected to a suction tube (not shown). Further, the illustrated vacuum cleaner is arranged with support wheels 11, 12. Moreover, the prior art vacuum cleaner shown in FIG. 2 comprises a flexible bellow 13, the corrugations 14 of which causes noise when air is drawn with high velocity through the bellow 13. The inventive bellow arrangement described in detail in the following aims at providing an improved nozzle and vacuum cleaner by improving a prior art bellow such as that shown in FIG. 2.

Figure 3:
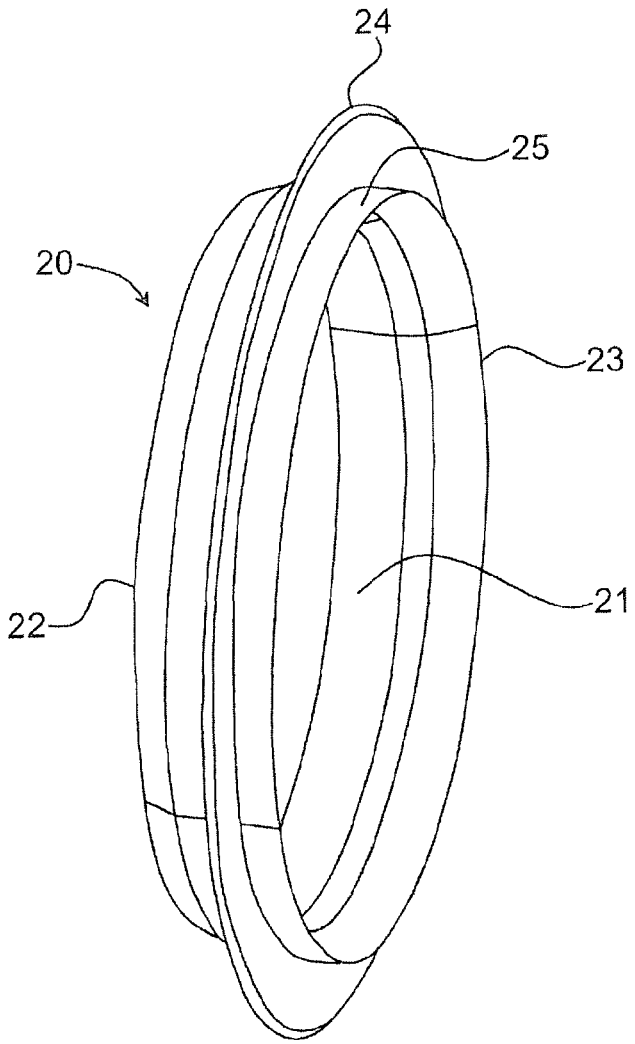
FIG. 3 shows an annular element used in a bellow arrangement according to an embodiment of the present invention.

FIG. 3 shows an annular element used in a bellow arrangement of a vacuum cleaner nozzle according to an embodiment of the present invention. The annular element 20 is arranged with a flat inside surface 21 preferably from a low-friction material such as plastic. The annular element has two radial end faces 22, 23. In an embodiment, the annular element 20 is arranged with a radially protruding flange 24 for engaging with a corrugation of a bellow, as will be shown in the following. It should be noted that as an alternative to providing the annular element 20 with a flange 24 along its circumference 25, the annular element 20 could have a flat outside surface, i.e. its circumference 25 could be flat, in which case the annular element 20 would have to be attached to the bellow by means of for instance adhesive.

Figure 4:
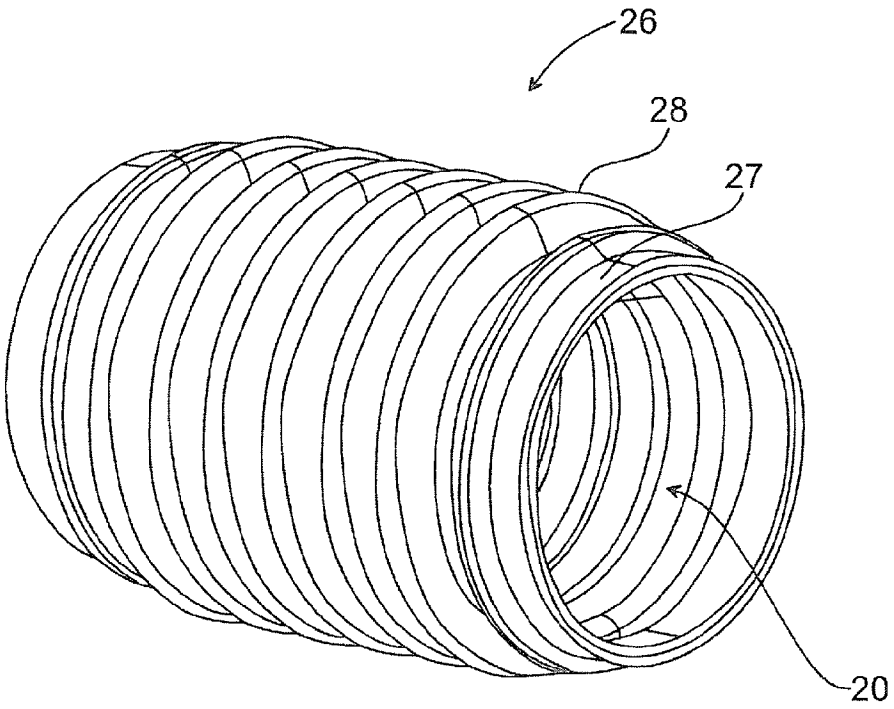
FIG. 4 shows a flexible bellow arrangement according to an embodiment of the present invention.

FIG. 4 shows a flexible bellow arrangement 26 comprising annular elements 20 axially arranged inside a tubular bellow 27 according to an embodiment of the present invention. The radially protruding flange 24 of each annular element 20 engages with a respective corrugation 28 of the tubular bellow 27. Thus, the annular elements 20 provide radial support to the tubular bellow 27, thereby preventing the bellow from collapsing by vacuum when air is drawn through the bellow. As previously mentioned, even though the bellow arrangement 26 is illustrated as being arranged with annular elements 20, thus resulting in a circular cross-section, a bellow arrangement having other cross-sectional shapes (and correspondingly shaped elements 20) is envisaged, such as an oval or rectangular cross-section.

Figure 5:
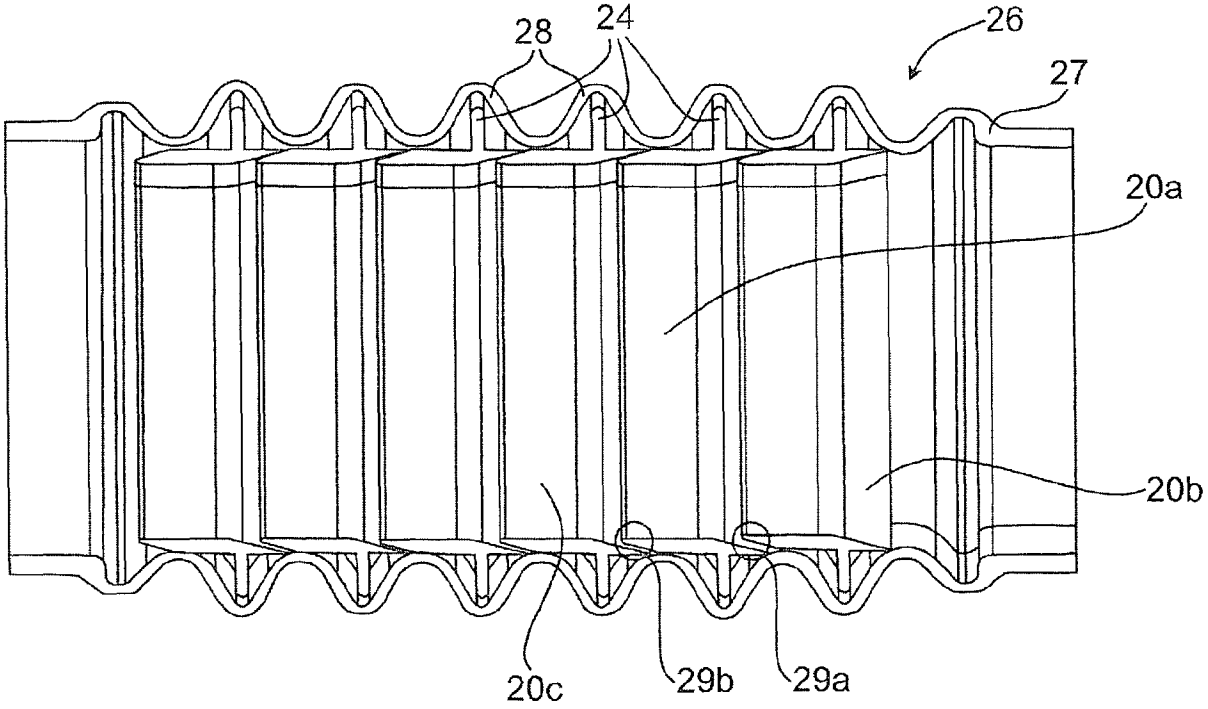
FIG. 5 shows a sectional view of the bellow arrangement shown in FIG. 4.

FIG. 5 shows a sectional view of the bellow arrangement 26 shown in FIG. 4 comprising annular elements 20*a*, 20*b*, 20*c* axially arranged inside a tubular bellow 27 according to an embodiment of the present invention. The radially protruding flange 24 of each annular element 20 engages with a respective corrugation 28 of the tubular bellow 27. Thus, the annular elements 20 provide radial support to the tubular bellow 27, thereby preventing the bellow from collapsing by vacuum when air is drawn through the bellow. The annular elements 20 are arranged to axially move in relation to each other when the bellow 27 is expanded, compressed or bent thus facilitating flexibility of the bellow arrangement 26. Further, as can be seen in FIG. 5, the annular elements 20 create a flat inside surface inside the bellow arrangement 26 such that air can be drawn through the arrangement without causing turbulence and resulting noise.

With reference to FIG. 5, in a further embodiment of the present invention, at least one axial end face of the respective annular element 20*a* is bevelled 29*a* such that each annular element can slide onto an adjacent annual element 20*b* abutting said bevelled axial end face. This will allow the annual elements 20 to move freely in the axial direction of the tubular bellow 27.

In yet a further embodiment of the present invention, both axial end faces of the respective annular element 20*a* are bevelled 29*a*, 29*b* such that each annular element can slide onto an adjacent annual element 20*b* abutting one of the two bevelled axial end faces, wherein the bevelling 29*a*, 29*b* of each axial end face is arranged to be fitted with the bevelling of the respective abutting axial end face of the two adjacent annular elements 20*b*, 20*c*.

The flexible bellow arrangement 27 is advantageously arranged in a vacuum cleaner nozzle of the present invention for transporting, to the nozzle outlet, debris picked up by the nozzle inlet for subsequent transport via the suction tube to the dust bag or cyclone arrangement located in the vacuum cleaner main body.

Even though the invention has been described with reference to specific exemplifying embodiments thereof, many different alterations, modifications and the like will become apparent for those skilled in the art. The described embodiments are therefore not intended to limit the scope of the invention, as defined by the appended claims.

The invention claimed is:

1. A vacuum cleaner nozzle comprising a flexible bellow arrangement for connecting a nozzle inlet to a nozzle outlet, the bellow arrangement having a flat inside surface and comprising a tubular bellow and a plurality of annular elements arranged axially inside the tubular bellow for radially supporting the tubular bellow, each of the annular elements having a respective flat inside portion, the flat inside portions of the annular elements collectively forming the flat inside surface, wherein the annular elements are arranged to axially move in relation to each other.

2. The vacuum cleaner nozzle of claim 1, wherein adjacent elements are located at a distance from each other when the tubular bellow is expanded and in contact with each other when the tubular bellow is in a compressed condition.

3. The vacuum cleaner nozzle of claim 1, wherein each element is fastened to the tubular bellow.

4. The vacuum cleaner nozzle of claim 1, wherein each element comprises a radially protruding flange along an outer circumference of the element, and the radially protruding flange of each elements engages a respective corrugation of the tubular bellow.

5. The vacuum cleaner nozzle of claim 1, wherein a first axial end face of at least one element comprises a first bevelled surface, such that the at least one element can slide onto a first adjacent element abutting the first bevelled surface of the first axial end face.

6. The vacuum cleaner nozzle of claim 5, wherein a second axial end face of the at least one element comprises a second bevelled surface such that the at least one element can slide onto a second adjacent element abutting the second bevelled surface of the second axial end face.

7. The vacuum cleaner nozzle of claim 1, wherein the flexible bellow arrangement is configured to transport, to the nozzle outlet, debris picked up by the nozzle inlet.

8. The vacuum cleaner nozzle of claim 1, wherein the elements are oval.

9. The vacuum cleaner nozzle of claim 1, wherein the elements are rectangular.

10. A vacuum cleaner comprising the nozzle of claim 1.

11. The vacuum cleaner nozzle of claim 1, wherein the plurality of annular elements comprises:

a first annular element having a respective first bevelled axial end face and a respective second bevelled axial end face;

a second annular element having a respective first bevelled axial end face and a respective second bevelled axial end face; and a third annular element having a respective first bevelled axial end face and a respective second bevelled axial end face; and wherein:

the second annular element is located between the first annular element and the third annular element, the first bevelled axial end face of the first annular element is positioned adjacent the second bevelled axial end face of the second annular element, and the first bevelled axial end face of the second annular element is positioned adjacent the second bevelled axial end face of the third annular element.

12. The vacuum cleaner nozzle of claim 1, wherein each of plurality of annular elements comprises a respective first bevelled axial end face and a respective second bevelled axial end face, and each pair of adjacent annular elements is arranged with the first bevelled axial end face of one adjacent annular element facing the second bevelled axial end face of the other adjacent annular element.

13. A vacuum cleaner nozzle comprising:

an inlet;

an outlet;

a flexible bellow connecting the inlet to the outlet, the flexible bellow comprising a plurality of corrugations;

a plurality of annular elements formed separately from and inserted inside the flexible bellow, each annular element having a respective first end face, a respective second end face, and a respective inner surface joining the respective first end face to the respective second end face;

wherein each adjacent pair of annular elements is oriented with the respective first end face of one of the adjacent pair of annular elements facing a respective second end face of the other of the adjacent pair of annular elements; and wherein, the plurality of annular elements are configured to move in relation to each other and with the flexible bellow, and when the flexible bellow is oriented in a straight line, the respective inner surfaces of the plurality of annular elements collectively form a flat inner surface extending from the inlet to the outlet.

14. The vacuum cleaner nozzle of claim 13, wherein adjacent ones of the plurality of annular elements are located at a distance from each other when the bellow is axially expanded and in contact with each other when the bellow is axially compressed.

15. The vacuum cleaner nozzle of claim 13, wherein each annular element comprises a separate annular ring.

16. The vacuum cleaner nozzle of claim 13, wherein each annular element comprises a respective radially-protruding flange extending from an outer circumference of the annular element, each respective radially-protruding flange being located within a respective corrugation of the flexible bellow.

17. The vacuum cleaner nozzle of claim 13, wherein the first end face of each of the plurality of annular elements comprises a first bevelled surface.

18. The vacuum cleaner nozzle of claim 17, wherein the second end face of each of the plurality of annular elements comprises a second bevelled surface, the second bevelled surface being configured to match the shape of the first bevelled surface.

* * * * *